US006739546B2

(12) United States Patent
Hashimoto

(10) Patent No.: US 6,739,546 B2
(45) Date of Patent: May 25, 2004

(54) AXIAL-POSITION ADJUSTMENT APPARATUS FOR ARM SHAFT EQUIPPED WITH PAPER ROLL SUPPORT ARMS IN PAPER WEB FEED UNIT

(75) Inventor: Teruo Hashimoto, Kawasaki (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/353,942

(22) Filed: Jan. 30, 2003

(65) Prior Publication Data

US 2003/0173453 A1 Sep. 18, 2003

(30) Foreign Application Priority Data

Mar. 15, 2002 (JP) ..... 2002-071851

(51) Int. Cl.[7] ..... B65H 19/12

(52) U.S. Cl. ..... 242/559.2; 242/563.1; 242/592; 242/596.1; 242/596.8

(58) Field of Search ..... 242/596, 596.1, 242/596.8, 563.1, 559.2, 592

(56) References Cited

U.S. PATENT DOCUMENTS 2,066,377 A * 1/1937 Wean et al. ..... 242/592
6,328,249 B1 * 12/2001 Ogawa et al. ..... 242/559.2

OTHER PUBLICATIONS

Newspaper Printing Handbook, Japan Newspaper Publishers & Editors Association, pp. 101–103—Apr. 10, 1997.

Newspaper Printing, Japan Newspaper Publishers Y Editors Association, pp. 65–66, Oct. 31, 1980.

* cited by examiner

*Primary Examiner*—John M. Jillions
(74) *Attorney, Agent, or Firm*—Westerman, Hattori, Daniels & Adrian, LLP

(57) ABSTRACT

An axial-position adjustment apparatus is used to adjust the axial position of an arm shaft equipped with paper roll support arms. The arm shaft is supported rotatably and axially movably on a frame in a paper web feed unit and rotated by means of a shaft-rotating apparatus located at one end portion of the arm shaft. The axial-position adjustment apparatus has a moving member including a male screw and connected to the arm shaft in such a manner as to be rotatable and axially immovable in relation to the arm shaft; a guide member having a threaded hole formed therein, the male screw of the moving member being screwed in the threaded hole, and the guide member being provided in such a manner as to be nonrotatable and axially immovable in relation to the frame; and a drive unit for rotating the moving member. The moving member and the guide member are located adjacent to the shaft-rotating apparatus. The drive unit is provided on a support member axially immovably connected to the arm shaft.

13 Claims, 5 Drawing Sheets

AXIAL-POSITION ADJUSTMENT APPARATUS FOR ARM SHAFT EQUIPPED WITH PAPER ROLL SUPPORT ARMS IN PAPER WEB FEED UNIT

BACKGROUND OF THE INVENTION

1. Field of the Invention

The present invention relates to an axial-position adjustment apparatus for an arm shaft equipped with paper roll support arms in a paper web feed unit, adapted to adjust the axial position of the arm shaft so as to adjust the axial position of a side edge of paper web to fall within a predetermined range.

2. Description of the Related Art

Conventionally, a paper web feed unit of a rotary printing press is loaded with one to three paper rolls. As shown in FIGS. 4 and 5, a paper web feed unit R of a rotary newspaper-printing press includes an arm shaft 01 rotatably supported by frames F1 and F2, and pairs of paper roll support arms A1 and A2 mounted on the arm shaft 01 such that the paired paper roll support arms A1 and A2 face each other with a predetermined interval established therebetween. A paper roll M is supported between end portions of the paper roll support arms A1 and A2.

Center cones C1 and C2 are provided at the corresponding end portions of the paper roll support arms A1 and A2 while facing each other on the same axis. One center cone C1 is provided in an axially fixed condition, whereas the other center cone C2 is provided in an axially movable condition. Conical portions of the center cones C1 and C2 are inserted into opposite end opening portions of a tubular paper core of the paper roll M, thereby rotatably supporting the paper roll M by the paper roll support arms A1 and A2.

Since the diameter of an opening portion of the tubular paper core varies greatly among paper rolls M, the insertion depth of a conical portion of the axially fixed center cone C into the opening portion of the tubular paper core is not constant. The axially protrudable center cone C2 presses the paper roll M toward the axially fixed center cone C1, thereby causing the paper roll M to move toward the center cone C1. Therefore, the position of the paper roll M in the axial direction (in the width direction) varies.

Therefore, a side edge E of the paper roll M thus supported by the paper roll support arms A1 and A2 may shift axially beyond a predetermined range. In order to adjust the axial position of the side edge E to fall within the predetermined range, an arm-shaft axial-position adjustment apparatus (hereinafter called as an "axial-position adjustment apparatus) K02 is used for axially moving the arm shaft 01 on which the paper roll support arms A1 and A2 are mounted.

Electric devices for controlling a center cone actuator, a tension control brake, and the like are provided on the paper roll support arms A1 and A2. Electricity is supplied to these electric devices from slip ring units S01 and S02 provided separately from each other at the opposite sides of the arm shaft 01.

The above-described conventional axial-position adjustment apparatus K02 is described in, for example, "Newspaper Printing Handbook," edited by The Technical Committee of The Japan Newspaper Publishers & Editors Association, published by The Japan Newspaper Publishers & Editors Association, Apr. 10, 1997, pp. 101–103. As shown in FIG. 5, the axial-position adjustment apparatus K02 is provided at one end portion of the arm shaft 01 in the paper web feed unit R, whereas an arm-shaft-rotating apparatus (hereinafter called a "shaft-rotating apparatus") K01 for imparting an angular displacement to the paper roll support arms A1 and A2 is provided at the other end portion of the arm shaft 01.

The axial-position adjustment apparatus K02 is also described in "Newspaper Printing," edited by The Engineering Committee of The Japan Newspaper Publishers & Editors Association, published by The Japan Newspaper Publishers & Editors Association, Oct. 31, 1980, pp. 65 and 66.

The axial-position adjustment apparatus K02 will be described in detail with reference to FIG. 6. The arm shaft 01 has a diameter-reduced shaft end portion 011, which is integral with the remaining portion of the arm shaft 01 via a step. The arm shaft 01 is rotatably and axially movably supported, via a sleeve 02, in a shaft hole formed in a casing B attached to an unillustrated frame. A male screw 011*a* is formed on an end part of the shaft end portion 011 located within the casing B.

A sleeve 03 having a radially inward protruding flange 03*a* is inserted into the shaft hole of the casing B. A slide key provided on the wall of the shaft hole prevents rotation of the sleeve 03 while allowing axial movement of the sleeve 03.

The arm shaft 01 is rotatably inserted into the bore of the sleeve 03; the shaft end portion 011 is inserted into the bore of the radially inward protruding flange 03*a*; and the end face of the radially inward protruding flange 03*a* is in contact with the step of the arm shaft 01.

An annular male screw member 04 greater in diameter than the sleeve 03 is bolted to the radially inward protruding flange 03*a*. The thus-bolted annular male screw member 04 and the radially inward protruding flange 03*a* are sandwiched between the step of the arm shaft 01 and a nut 05 engaged with the male screw 011*a* of the shaft end portion 011 of the arm shaft 01, to thereby be axially immovable in relation to the arm shaft 01.

A worm wheel 07 having a female screw 06 formed on its bore is provided within the casing B coaxially with the arm shaft 01 in a rotatable, axially immovable condition, while being engaged with a worm 08 to be rotated.

The annular male screw member 04 is engaged with the female screw 06 of the worm wheel 07.

When the worm 08 engaged with the worm wheel 07 is rotated by a motor 09 (FIG. 4), the female screw 06 of the worm wheel 07 rotates. The annular male member 04, which, together with the sleeve 03, is nonrotatable, converts rotation of the female screw 06 to an axial movement of the annular male member 04, thereby axially moving the arm shaft 01 via the sleeve 03.

Electric devices provided on the paper roll support arms A1 and A2 receive electricity from the slip ring units S01 and S02 provided separately from each other at the opposite sides of the arm shaft 01. Since the axial-position adjustment apparatus K02 is provided at the shaft end portion 011 of the arm shaft 01, whereas the shaft-rotating apparatus K01 is provided at the other end portion of the arm shaft 01, the slip ring unit S01 is provided within a narrow space between the frame F1 and the paper roll support arm A1, and the slip ring unit S02 is provided within a narrow space between the frame F2 and the paper roll support arm A2.

Conventional axial-position adjustment apparatuses such as those described above involve the following problems.

Since the axial-position adjustment apparatus is provided at an end portion of an arm shaft opposite the end portion at which a shaft-rotating apparatus is provided, space for mounting a slip ring unit is limited. Meanwhile, in recent years, demand for high-speed color printing of newspapers has been increasing in newspaper publishing companies. Thus, rotary newspaper-printing presses have been required to provide precision tension control on paper web in order to maintain or enhance printing quality in high-speed printing.

In order to meet the demand, a large number of control devices required for precision tension control on paper web are provided on paper roll support arms in a paper web feed unit, thereby increasing the number of wiring lines for electricity supply. Therefore, a slip ring unit for a large number of wiring lines must be mounted. However, such a slip ring unit requires wide space along the axial direction of the arm shaft, but the conventional axial-position adjustment apparatuses fail to provide such wide space for mounting the slip ring unit.

SUMMARY OF THE INVENTION

An object of the present invention is to solve the above-mentioned problem involved in the conventional axial-position adjustment apparatuses and to provide an axial-position adjustment apparatus for an arm shaft equipped with paper roller support arms in a paper web feed unit, allowing installation thereof adjacent to a shaft-rotating apparatus at one end portion of the arm shaft so as to provide ample space for mounting a slip ring unit at the other end portion of the arm shaft.

To achieve the above object, the present invention provides an axial-position adjustment apparatus for an arm shaft equipped with paper roll support arms, the arm shaft being supported rotatably and axially movably on a frame of a paper web feed unit and rotated by means of a shaft-rotating apparatus located at one end portion of the arm shaft.

The axial-position adjustment apparatus comprises a moving member including a screw portion and connected to the arm shaft in such a manner as to be rotatable and axially immovable in relation to the arm shaft; a guide member including a screw portion engaged with the screw portion of the moving member, the guide member being provided in such a manner as to be nonrotatable and axially immovable in relation to the frame; and a drive unit for rotating the moving member, the drive unit comprising, for example, a motor.

Preferably, the moving member and the guide member are provided adjacent to the shaft-rotating apparatus; the drive unit for rotating the moving member is provided on a support member connected to the arm shaft in such a manner as to be rotatable and axially immovable in relation to the arm shaft; and the screw portion of the moving member and the screw portion of the guide member are of trapezoidal threads or of a ball screw.

In a rotary printing press, the axial-position adjustment apparatus for an arm shaft is adapted to adjust the axial position of a side edge of paper web.

When a side edge of paper web running and being fed from a paper roll shifts axially beyond a predetermined range, the motor receives a rotation signal that is output on the basis of a signal from a detector, and starts rotating in such a direction as to move the side edge in a direction opposite the shift. The motor continues rotating until the side edge position is restored to within the predetermined range. Subsequently, when the detector detects that the side edge position falls within the predetermined range, the output of the rotation signal stops, and thus the motor stops rotating.

Rotation of the motor causes the screw portion of the moving member to rotate, whereby the moving member moves in the axial direction. Axial movement of the moving member is transmitted to the arm shaft independent of rotation of the arm shaft, thereby moving the roll paper support arms; i.e., the paper roll, and thus adjusting the position of the side edge of paper web accordingly.

According to the present invention, the axial-position adjustment apparatus for an arm shaft is provided adjacent to the shaft-rotating apparatus at one end portion of the arm shaft, thereby providing ample space for mounting a slip ring unit at the other end portion of the arm shaft and thus enabling installation of a slip ring unit having a large number of wiring lines. Therefore, a large number of control devices can be provided on paper roll support arms in a paper web feed unit in order to carry out precision tension control on paper web for maintaining or enhancing printing quality, thereby enabling implementation of a rotary printing press capable of performing high-quality, high-speed color printing.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

An axial-position adjustment apparatus according to an embodiment of the present invention for an arm shaft equipped with paper roll support arms in a paper web feed unit will next be described in detail with reference to the drawings.

Figure 3:
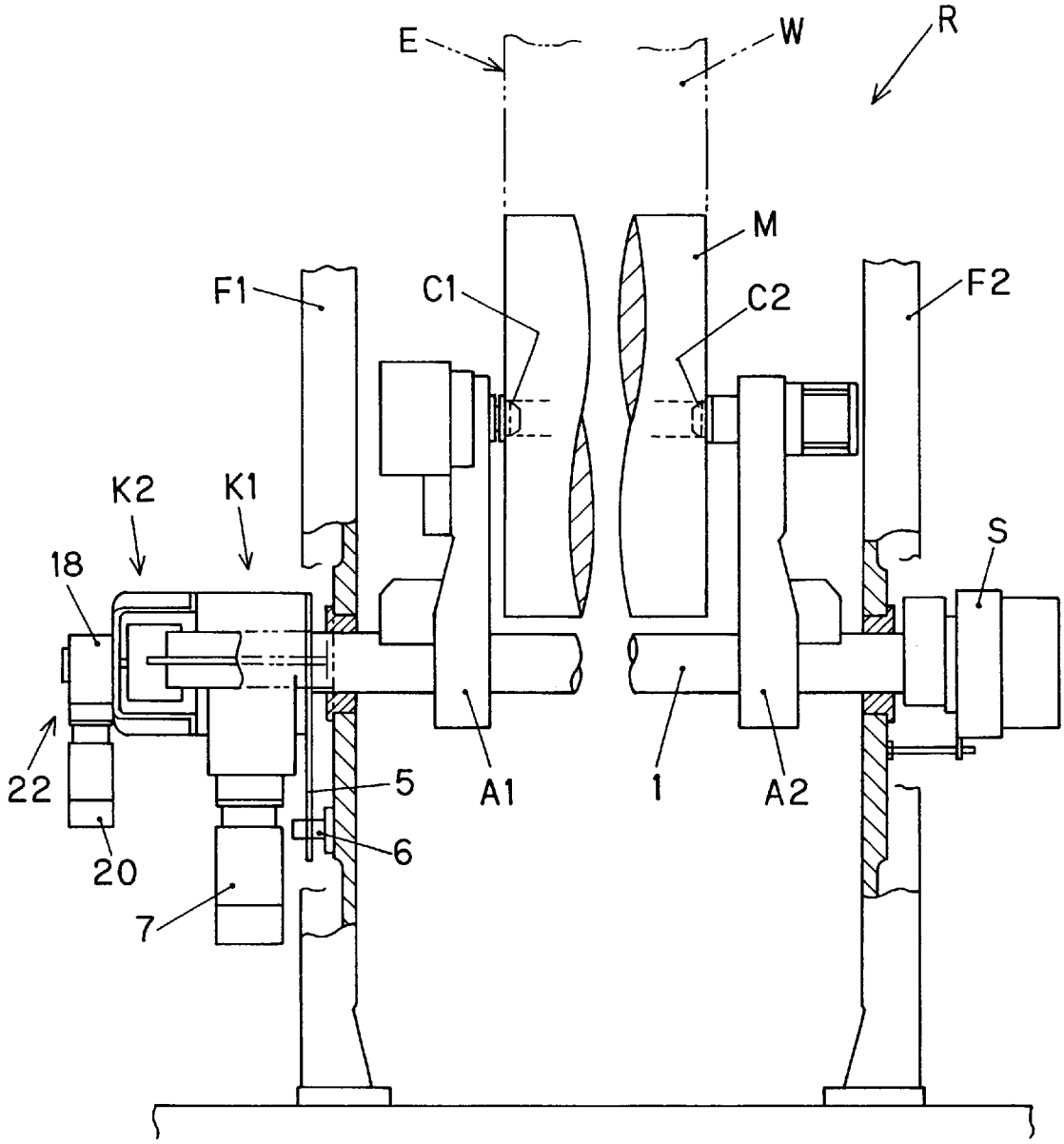
FIG. 3 is a schematic view showing a paper web feed unit having the axial-position adjustment apparatus of FIG. 1.
Figure 4:
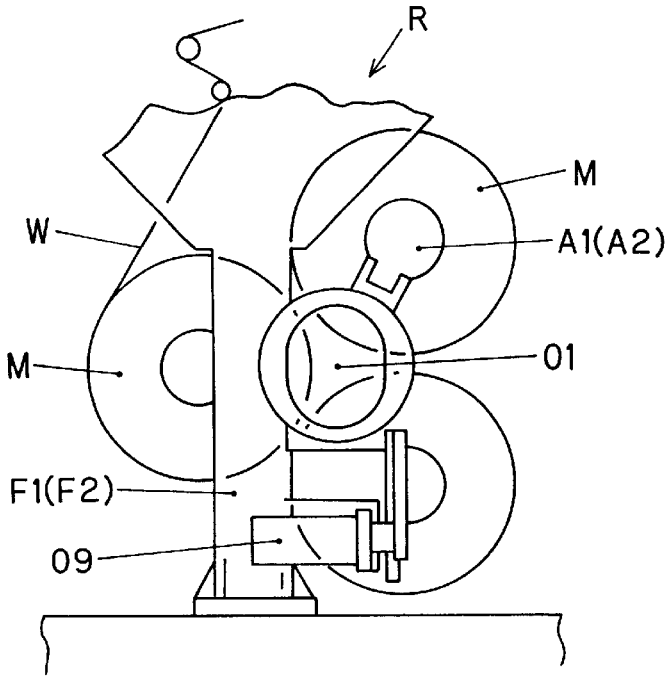
FIG. 4 (PRIOR ART)
FIG. 4 is a schematic side view of a conventional paper web feed unit.
Figure 5:
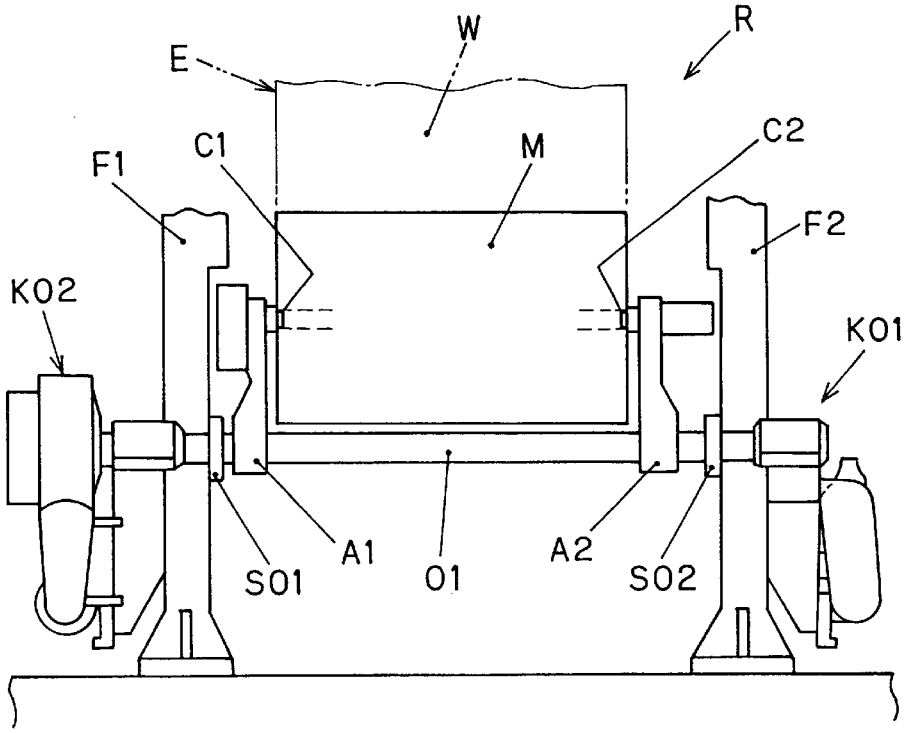
FIG. 5 (PRIOR ART)
FIG. 5 is a schematic front view of the conventional paper web feed unit of FIG. 4.
Figure 6:
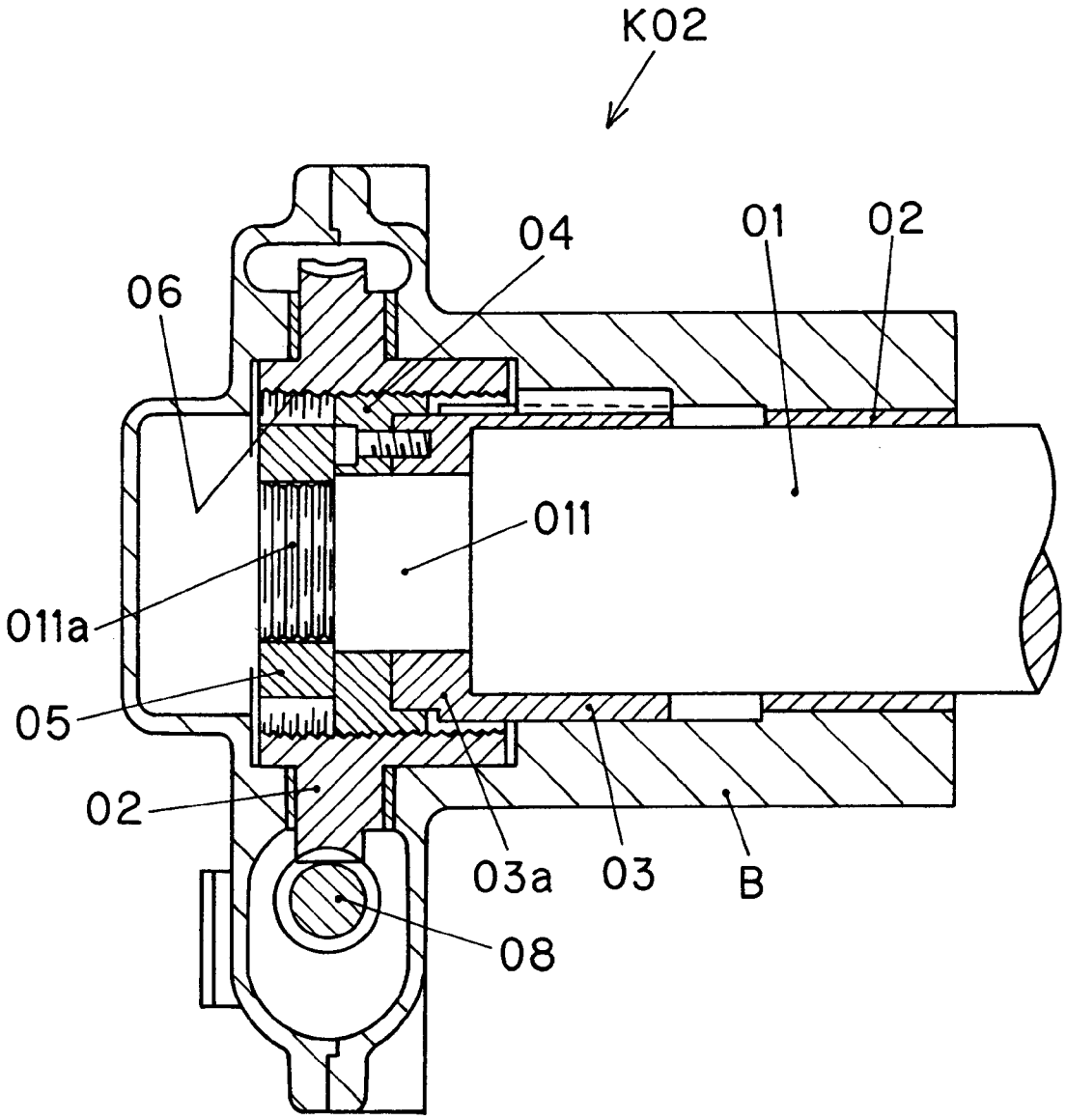
FIG. 6 (PRIOR ART)
FIG. 6 is a sectional view of a conventional axial-position adjustment apparatus.

First, a paper web feed unit R of a rotary printing press will be described. As shown in FIG. 3, an arm shaft 1 is supported at opposite ends by mutually facing frames F1 and F2, in a rotatable, axially movable condition. One to three pairs of paper roll support arms are mounted on the arm shaft 1 such that the paired paper roll support arms face each other with a predetermined interval established therebetween. FIG. 3 shows a pair of paper roll support arms A1 and A2.

Center cones C1 and C2 are provided rotatably at the corresponding end portions of the paper roll support arms A1 and A2 while facing each other on the same axis.

One center cone C1 is provided in an axially fixed condition, whereas the other center cone C2 is provided in an axially movable condition.

Conical portions of the center cones C1 and C2 are inserted into opposite end opening portions of a tubular paper core of a paper roll M, thereby rotatably supporting the paper roll M by the paper roll support arms A1 and A2.

Opposite end portions of the arm shaft 1 protrude axially outward from the corresponding frames F1 and F2. An arm-shaft-rotating apparatus (hereinafter called a "shaft-rotating apparatus") K1 for rotating the arm shaft 1 and an arm-shaft axial-position adjustment apparatus (hereinafter called an "axial-position adjustment apparatus") K2 are provided adjacent to each other at one shaft end portion. Therefore, wide space can be provided at the other shaft end portion for installation of a slip ring unit S.

Figure 1:
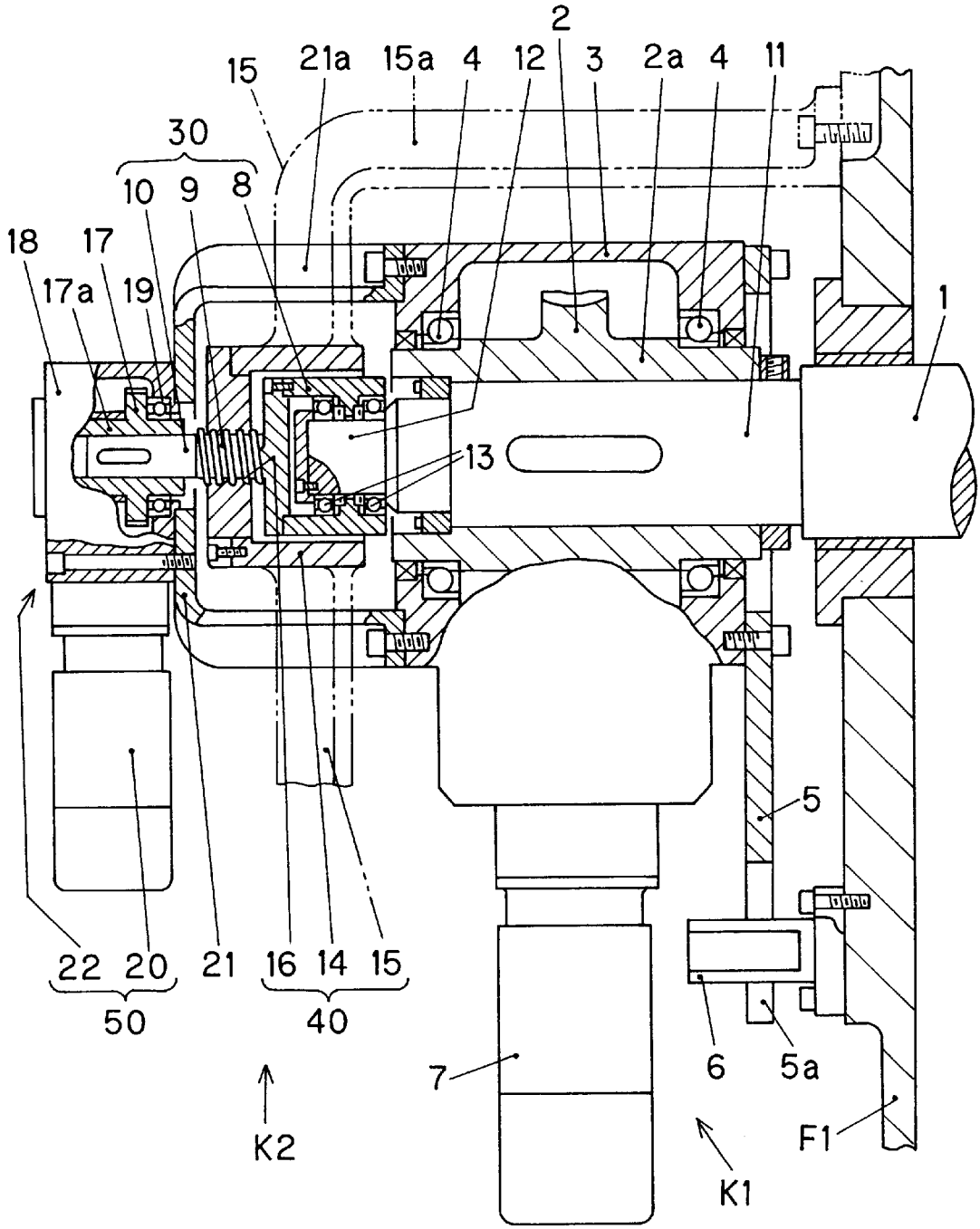
FIG. 1 is a partially sectioned view of an axial-position adjustment apparatus according to an embodiment of the present invention provided at one end portion of an arm shaft.

As shown in FIG. 1, the shaft-rotating apparatus K1 and the axial-position adjustment apparatus K2 are provided adjacent to each other at an end portion of the arm shaft 1 such that the shaft-rotating apparatus K1 is sandwiched between the axial-position adjustment apparatus K2 and the frame F1. The end portion of the arm shaft 1 is stepped so as to form a first shaft end portion 11 smaller in diameter than an intermediate portion of the arm shaft 1 and a second shaft end portion 12 smaller in diameter than the first shaft end portion 11 and projecting from the first shaft end portion 11.

In the shaft-rotating apparatus K1, a worm wheel 2 is fixedly attached to the first shaft end portion 11; and a first casing 3 is provided to cover the worm wheel 2. Specifically, the first casing 3 is supported via two angular contact ball bearings 4 on a cylindrical boss 2*a* of the worm wheel 2 in such a manner as to be rotatable and axially immovable in relation to the worm wheel 2.

A rotation restraint leg 5 having a forked end portion 5*a* protrudes radially from the first casing 3. A guide pin 6 protruding outward from the frame F1 is inserted into the forked end portion 5*a* of the rotation restraint leg 5. Therefore, the first casing 3 is allowed to axially move in relation to the frame F1, but is restrained from rotating about the axis of the arm shaft 1 while moving along the axial direction of the arm shaft 1 along the length of the guide pin 6.

The first casing 3 houses the worm wheel 2 and a worm (not shown) engaged with the worm wheel 2, thereby forming a reduction gear, to which a motor 7 for rotating the arm shaft 1 is attached.

The axial-position adjustment apparatus K2 is configured in the following manner. A cup-shaped second casing 8 covers the second shaft portion 12 from the shaft end side. A shaft portion 10 protrudes axially outward from the center of a bottom portion of the second casing 8. A male screw 9 is formed at a proximal end part of the shaft portion 10. The second casing 8 is attached via two angular contact ball bearings 13 to the second shaft portion 12 in such a manner as to be rotatable and axially immovable in relation to the second shaft portion 12. The second casing 8, the male screw 9, the shaft portion 10, and the two angular contact ball bearings 13 constitute a moving member 30.

A cup-shaped stationary casing 14, which covers the second casing 8 from the shaft end side, is attached to a squarish-letter-U-shaped frame 15. The squarish-letter-U-shaped frame 15 has two leg portions 15*a* extending in parallel with the first shaft end portion 11. End parts of the two leg portions 15*a* are bolted to the frame F1. The stationary casing 14 is attached to an intermediate connection portion of the squarish-letter-U-shaped frame 15. Thus, the stationary casing 14 is fixedly attached to the frame F1 via the squarish-letter-U-shaped frame 15.

A threaded hole 16 is formed in a bottom portion of the stationary casing 14. The male screw 9 is screwed in the threaded hole 16, and a distal end part of the shaft portion 10 protrudes axially outward through the threaded hole 16. A worm wheel 17 is keyed on the distal end part of the shaft portion 10.

The stationary casing 14, the squarish-letter-U-shaped frame 15, and the threaded hole 16 constitute a guide member 40.

A third casing 18 is attached to a cylindrical boss 17*a* of the worm wheel 17 via a bearing 19 while covering the worm wheel 17. The third casing 18 houses the worm wheel 17 and a worm (not shown) engaged with the worm wheel 17, thereby forming a reduction gear 22, to which a motor 20 for rotating the shaft portion 10 of the moving member 30 is attached. The motor 20 and the reduction gear 22 constitute a drive unit 50.

A so-called gear motor such as HYPONIC DRIVE Model RNYM1 (a brake motor equipped with a reduction gear mechanism, a product of Sumitomo Heavy Industries, Ltd.) is used to implement each of the following mechanisms: the reduction gear composed of the worm wheel 2 and the worm engaged with the worm wheel 2, and the motor 7 for driving the reduction gear; and the reduction gear 22 composed of the worm wheel 17 and the worm engaged with the worm wheel 17, and the motor 20 for driving the reduction gear 22.

The reduction gear 22 of the drive unit 50 is attached to a squarish-letter-U-shaped frame 21. The squarish-letter-U-shaped frame 21 has two leg portions 21*a* extending in parallel with the second shaft end portion 12. End parts of the two leg portions 21*a* are bolted to the first casing 3. The reduction gear 22 of the drive unit 50 is attached to an intermediate connection portion of the squarish-letter-U-shaped frame 21. That is, the third casing 18 is integrally connected to the first casing 3 to thereby constitutes a support member.

Figure 2:
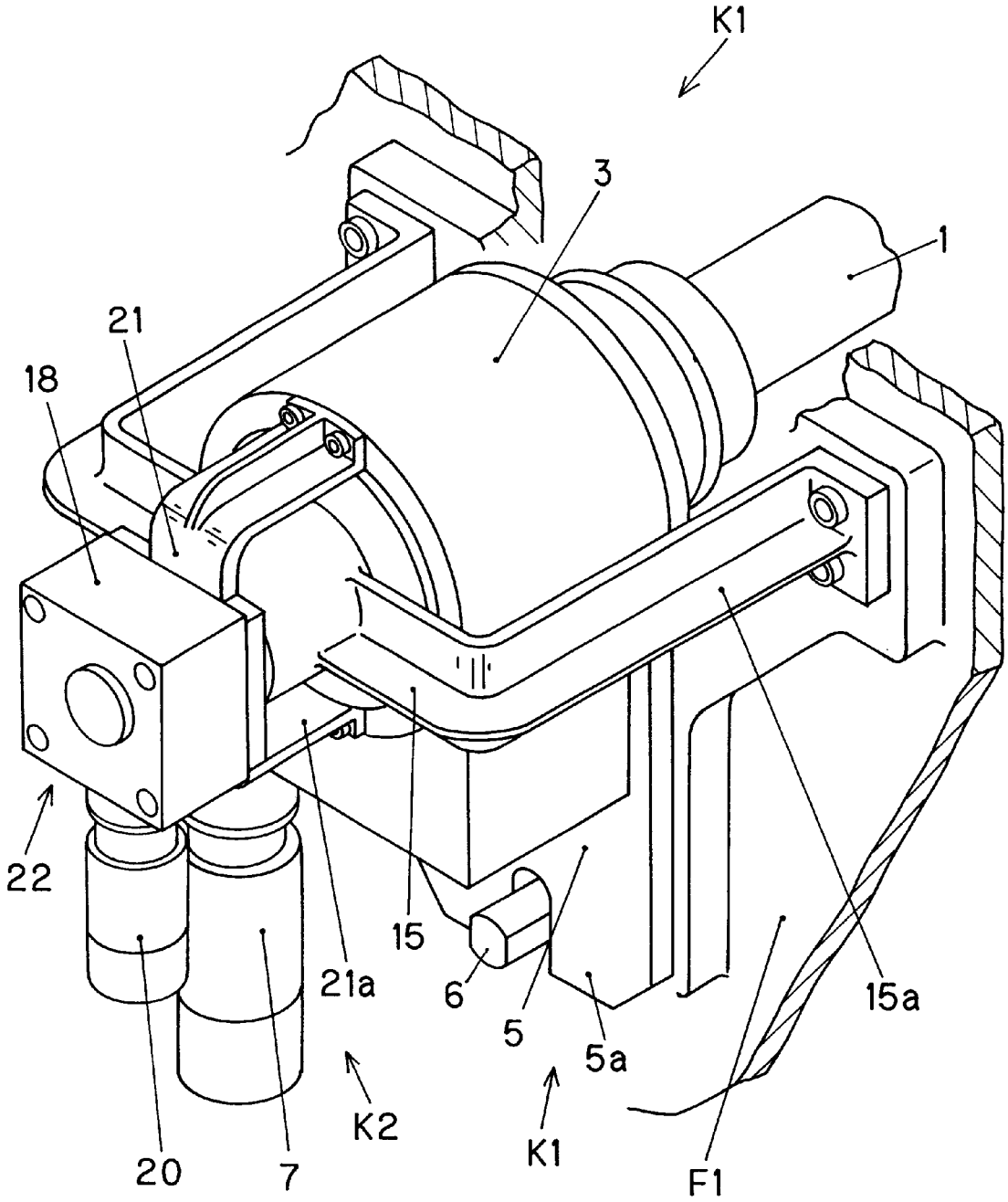
FIG. 2 is a perspective view of the axial-position adjustment apparatus of FIG. 1.

In order to avoid mutual interference, the squarish-letter-U-shaped frame 15 and the squarish-letter-U-shaped frame 21 are angularly shifted by 90 degrees from each other about the axis of the arm shaft 1 (see FIG. 2).

Notably, in the present embodiment, the male screw 9 and the threaded holes 16 have trapezoidal threads as shown in FIG. 1, but may be replaced with an unillustrated ball screw or any other screw mechanism.

In the course of operation of a rotary printing press, the axial-position adjustment apparatus K2 cooperates with an unillustrated detector for detecting the side edge E of running paper web W so as to restore, as needed, the position of the side edge E to within an unillustrated predetermined range.

Next, the operation of the above-described axial-position adjustment apparatus K2 will be described.

When, in the paper web feed unit R, a consumed paper roll M is to be replaced with a new paper roll M in the course of paper web joining process, the shaft-rotating apparatus K1 is operated. The motor 7—which is attached to the first casing 3 whose rotation about the arm shaft 1 is restrained by means of the rotation restraint leg 5 and the guide pin 6—is operated, whereby a predetermined amount of rotation of the motor 7 is transmitted to the first end portion 11 via worm gears (a worm (not shown) and the worm wheel 2), and the arm shaft 1 supported by the frames F1 and F2 rotates by a predetermined angle. That is, the paper roll support arms A1 and A2 mounted on the arm shaft 1 rotate by a predetermined angle, thereby rotating by the predetermined angle the new and old paper rolls M supported by the center cones C1 and C2.

Since the second shaft end portion 12 is supported by the second casing 8 via the two angular contact ball bearings 13, rotation of the arm shaft 1 effected by the shaft-rotating apparatus K1 is not transmitted to the second casing 8. Thus, the operation of the shaft-rotating apparatus K1 is independent of the axial-position adjustment apparatus K2.

When the position of the side edge E of paper web W is to be adjusted, the axial-position adjustment apparatus K2 is operated.

The axial-position adjustment apparatus K2, which is located adjacent to the shaft-rotating apparatus K1 for rotating the paper roll support arms A1 and A2, operates as follows. When the side edge E of paper web W, running and being fed from the paper roll M as shown in FIG. 3, shifts axially beyond a predetermined range, the motor 20 receives a rotation signal that is output on the basis of a signal from a detector, and starts rotating in such a direction as to move the side edge E in the direction opposite the shift. The motor 20 continues rotating until the position of the side edge E is restored to within the predetermined range.

Subsequently, when the detector detects that the position of the side edge E falls within the predetermined range, the rotation signal stops being output, and thus the motor 20 stops rotating.

Specifically, as shown in FIG. 1, rotation of the motor 20 is transmitted to the shaft portion 10 via the reduction gear 22, thereby rotating the male screw 9. Since the threaded hole 16 in which the male screw 9 is screwed is formed in the stationary casing 14 fixedly attached to the frame F1, the male screw 9; i.e., the second casing 8, moves axially in relation to the stationary casing 14.

When the male screw 9 and the threaded holes 16 are of right-hand threads, clockwise rotation of the shaft portion 10; i.e., the male screw 9, as viewed from the end face of shaft portion 10 causes the male screw 9 to be screwed into the stationary threaded hole 16 while rotating; as a result, the second casing 8 moves toward the frame F1.

The axial movement of the second casing 8 is transmitted to the second shaft portion 12; i.e., to the arm shaft 1, via the two angular contact ball bearings 13 placed between the second casing 8 and the second shaft portion 12, whereby the arm shaft 1 moves while being directed from the frame F1 to the frame F2. Therefore, the paper roll M loaded on the arm shaft 1; i.e., the side edge E of paper web W, moves away from the frame F1.

When the motor 20 rotates in the reverse direction to thereby cause counterclockwise rotation of the shaft portion 10; i.e., the male screw 9, the paper roll M; i.e., the side edge E of paper web W, moves toward the frame F1.

The movement of the arm shaft 1 causes the axial movement of the first casing 3 via the two angular contact ball bearings 4. However, since the axial movement of the rotation restraint leg 5 in relation to the guide pin 6; i.e., the axial movement of the first casing 3 in relation to the frames F1 and F2, is not restrained, the operation of the axial-position adjustment apparatus K2 is independent of the shaft-rotating apparatus K1.

Also, since the drive unit 50—composed of the motor 20 and the reduction gear 22 including the worm wheel 17 mounted on the shaft portion 10 and the worm engaged with the worm wheel 17—is attached to the first casing 3 via the squarish-letter-U-shaped frame 21, the drive unit 50 moves in unison with the first casing 3.

When the detector detects that the position of the side edge E of paper web W falls within a predetermined range, the output of the rotation signal stops, and thus the motor 20 stops rotating, thereby completing the position adjustment of the side edge E of the paper web W.

Needless to say, the axial-position adjustment apparatus K2 can be manually operated as needed by means of switch operation, but description thereof is omitted.

Obviously, numerous modifications and variations of the present invention are possible in light of the above teachings. It is therefore to be understood that within the scope of the appended claims, the present invention may be practiced otherwise than as specifically described herein.

What is claimed is:

1. An axial-position adjustment apparatus for an arm shaft equipped with paper roll support arms, said arm shaft being supported rotatably and axially movably on a frame in a paper web feed unit and being rotated by means of a shaft-rotating apparatus located at one end portion of said arm shaft, said axial-position adjustment apparatus comprising:

a moving member including a screw portion and connected to said arm shaft in such a manner as to be rotatable and axially immovable in relation to said arm shaft;

a guide member including a screw portion engaged with the screw portion of said moving member, said guide member being provided in such a manner as to be nonrotatable and axially immovable in relation to the frame; and a drive unit for rotating said moving member.

2. An axial-position adjustment apparatus for an arm shaft according to claim 1, wherein said moving member and said guide member are provided adjacent to said shaft-rotating apparatus.

3. An axial-position adjustment apparatus for an arm shaft according to claim 2, wherein said drive unit comprises a motor.

4. An axial-position adjustment apparatus for an arm shaft according to claim 2, wherein the screw portion of said moving member and the screw portion of said guide member are of trapezoidal threads.

5. An axial-position adjustment apparatus for an arm shaft according to claim 2, wherein the screw portion of said moving member and the screw portion of said guide member are of a ball screw.

6. An axial-position adjustment apparatus for an arm shaft according to claim 1, wherein said drive unit is provided on a support member connected to said arm shaft in such a manner as to be rotatable and axially immovable in relation to said arm shaft.

7. An axial-position adjustment apparatus for an arm shaft according to claim 6, wherein said drive unit comprises a motor.

8. An axial-position adjustment apparatus for an arm shaft according to claim 6, wherein the screw portion of said moving member and the screw portion of said guide member are of trapezoidal threads.

9. An axial-position adjustment apparatus for an arm shaft according to claim 6, wherein the screw portion of said moving member and the screw portion of said guide member are of a ball screw.

10. An axial-position adjustment apparatus for an arm shaft according to claim 2, wherein said drive unit is provided on a support member connected to said arm shaft in such a manner as to be rotatable and axially immovable in relation to said arm shaft.

11. An axial-position adjustment apparatus for an arm shaft according to claim 10, wherein said drive unit comprises a motor.

12. An axial-position adjustment apparatus for an arm shaft according to claim 10, wherein the screw portion of said moving member and the screw portion of said guide member are of trapezoidal threads.

13. An axial-position adjustment apparatus for an arm shaft according to claim 10, wherein the screw portion of said moving member and the screw portion of said guide member are of a ball screw.

* * * * *